US009366998B2

(12) United States Patent
Takifuji

(10) Patent No.: US 9,366,998 B2
(45) Date of Patent: Jun. 14, 2016

(54) BELT UNIT AND IMAGE FORMATION DEVICE

(75) Inventor: Kotaro Takifuji, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 262 days.

(21) Appl. No.: 13/432,831

(22) Filed: Mar. 28, 2012

(65) Prior Publication Data

US 2012/0315064 A1 Dec. 13, 2012

(30) Foreign Application Priority Data

Jun. 9, 2011 (JP) ..... 2011-129238

(51) Int. Cl.
*G03G 15/16* (2006.01)

(52) U.S. Cl.
CPC .. *G03G 15/1615* (2013.01); *G03G 2215/00151* (2013.01)

(58) Field of Classification Search
CPC ..... G03G 15/165; G03G 2215/1614; G03G 2215/1623; G03G 2215/0143; G03G 2215/00151; F16H 2055/363; F16H 55/49
USPC ..... 399/313; 474/179
See application file for complete search history.

(56) References Cited

U.S. PATENT DOCUMENTS

| | | | | |
|---|---|---|---|---|
| 3,536,239 | A * | 10/1970 | Strong | B26D 7/06 226/1 |
| 4,991,784 | A | 2/1991 | Schmid | |
| 2007/0041754 | A1* | 2/2007 | Hachisuga et al. | 399/302 |
| 2009/0084498 | A1* | 4/2009 | Shimizu | 156/304.1 |
| 2011/0116847 | A1* | 5/2011 | Wakana et al. | 399/313 |
| 2012/0237275 | A1* | 9/2012 | Fromm | 399/329 |

FOREIGN PATENT DOCUMENTS

| | | |
|---|---|---|
| JP | H-02150535 A | 6/1990 |
| JP | H04-68039 | 6/1992 |
| JP | 05-204199 | 8/1993 |
| JP | 2008-170478 | 7/2008 |

OTHER PUBLICATIONS

Dec. 16, 2014—(JP) Notification of Reasons for Rejection—App 2011-129238—Eng Tran.

* cited by examiner

*Primary Examiner* — Walter L Lindsay, Jr.
*Assistant Examiner* — Philip Marcus T Fadul
(74) *Attorney, Agent, or Firm* — Banner & Witcoff, Ltd.

(57) ABSTRACT

A belt unit is provided with an endless belt, a pair of rollers around which the endless belt is wound, and a regulating member having a flange surface provided at one axial end of at least one of the pair of rollers. The flange surface extends on an outer side with respect to an outer surface of the endless belt wound around the pair of rollers, the flange surface is configured to contact an end, in a width direction, of the endless belt to prevent the endless belt from moving obliquely, and the flange surface is formed with a conical surface which is configured such that a portion closer to a peripheral side of the conical surface is closer to an axial center of the at least one of the pair of rollers.

14 Claims, 9 Drawing Sheets

BELT UNIT AND IMAGE FORMATION DEVICE

CROSS-REFERENCE TO RELATED APPLICATION

This application claims priority under 35 U.S.C. §119 from Japanese Patent Application No. 2011-129238 filed on Jun. 9, 2011. The entire subject matter of the application is incorporated herein by reference.

BACKGROUND

1. Technical Field

Aspects of the present invention relates to a belt unit having an endless belt, and an image formation device employing the belt unit.

2. Conventional Art

Conventionally, an image formation device employing the endless belt has been known. In such an image formation device, the endless belt is wound around a pair of rollers. Typically, in such an image formation device, disk-like flange surfaces are provided at axial ends of the rollers in order to prevent the endless belt from moving in the axial direction (hereinafter, such a movement will be referred to as an oblique movement).

In the belt unit for the image formation device, if the endless belt moves obliquely, the image formed on a printing sheet which is fed by the endless belt may be largely deteriorated.

If a force to move the endless belt obliquely is relatively large, the endless belt may climb over the flange surfaces. Aspects of the invention is advantageous in that an improved belt unit which is capable of preventing the obliquely moving endless belt from climbing over the flange surfaces.

According to aspects of the invention, there is provided a belt unit, which is provided with an endless belt, a pair of rollers around which the endless belt is wound, and a regulating member having a flange surface provided at one axial end of at least one of the pair of rollers. The flange surface extends on an outer side with respect to an outer surface of the endless belt wound around the pair of rollers, the flange surface is configured to contact an end, in a width direction, of the endless belt to prevent the endless belt from moving obliquely, and the flange surface is formed with a conical surface which is configured such that a portion closer to a peripheral side of the conical surface is closer to an axial center of the at least one of the pair of rollers.

According to aspects of the invention, there is provided an electrophotographic image formation device, which is provided with an image formation unit forming a developed image formed by developer, and a belt unit. The belt unit is provided with an endless belt, a pair of rollers around which the endless belt is wound, and a regulating member having a flange surface provided at one axial end of at least one of the pair of rollers. The flange surface extends on an outer side with respect to an outer surface of the endless belt wound around the pair of rollers, the flange surface is configured to contact an end, in a width direction, of the endless belt to prevent the endless belt from moving obliquely, and the flange surface is formed with a conical surface which is configured such that a portion closer to a peripheral side of the conical surface is closer to an axial center of the at least one of the pair of rollers.

BRIEF DESCRIPTION OF THE ACCOMPANYING DRAWINGS

Figure 3A:
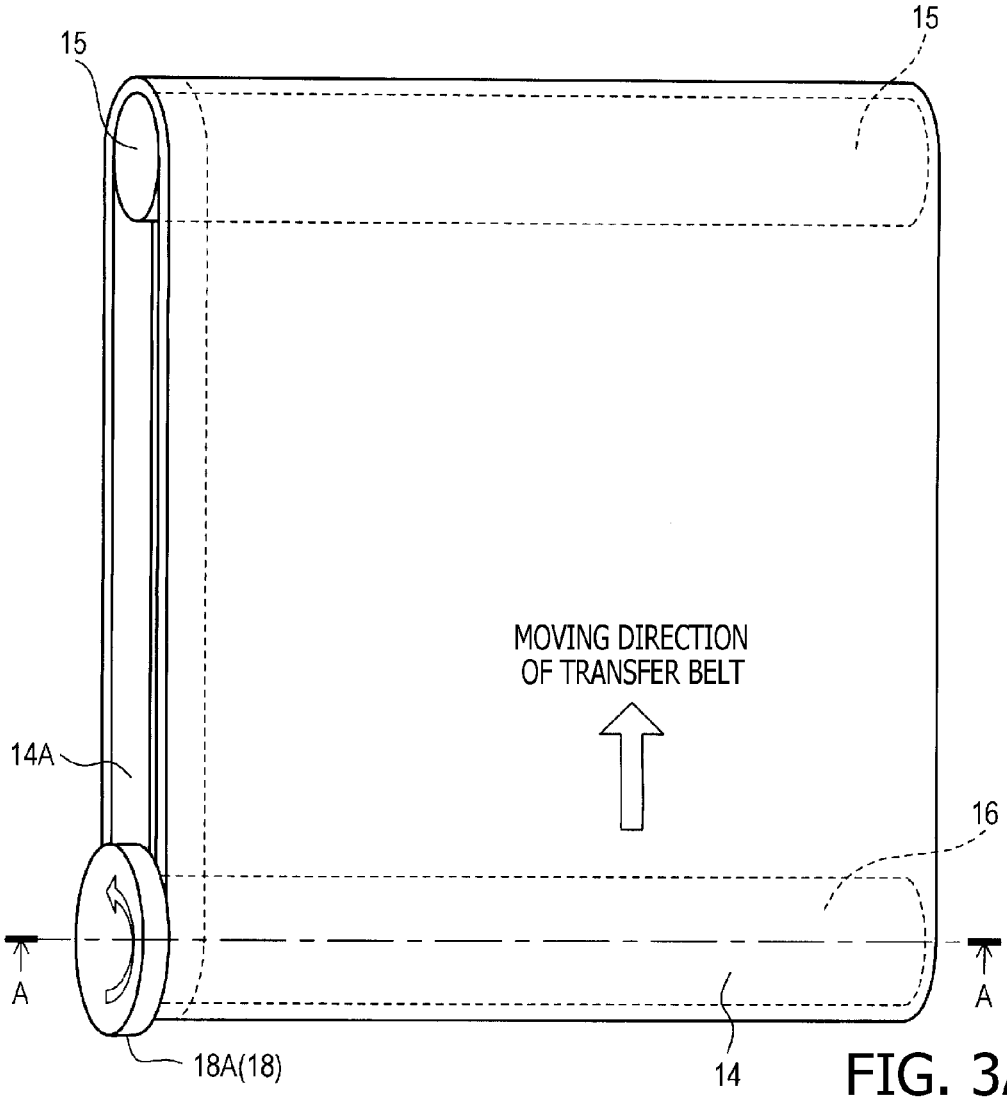

FIG. 3A schematically shows a structure of the belt unit according to the embodiment of the invention.

Figure 3B:
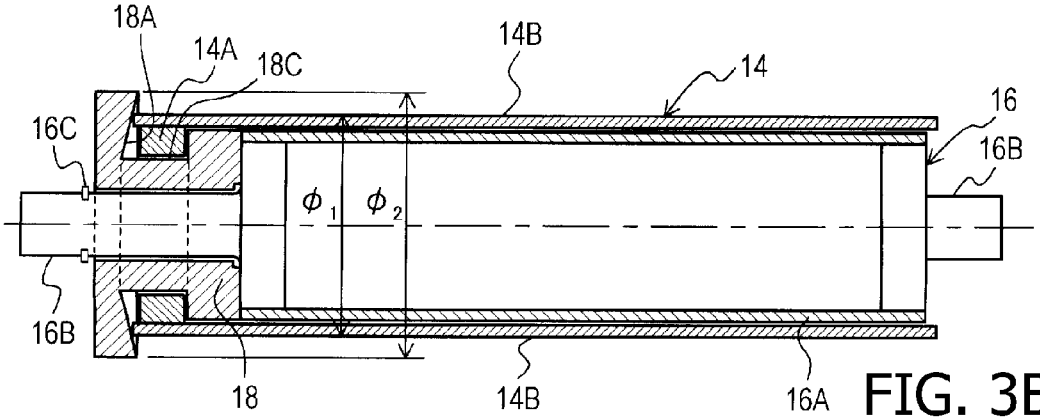

FIG. 3B is a cross sectional view of a driving roller employed in the belt unit.

Figure 4:
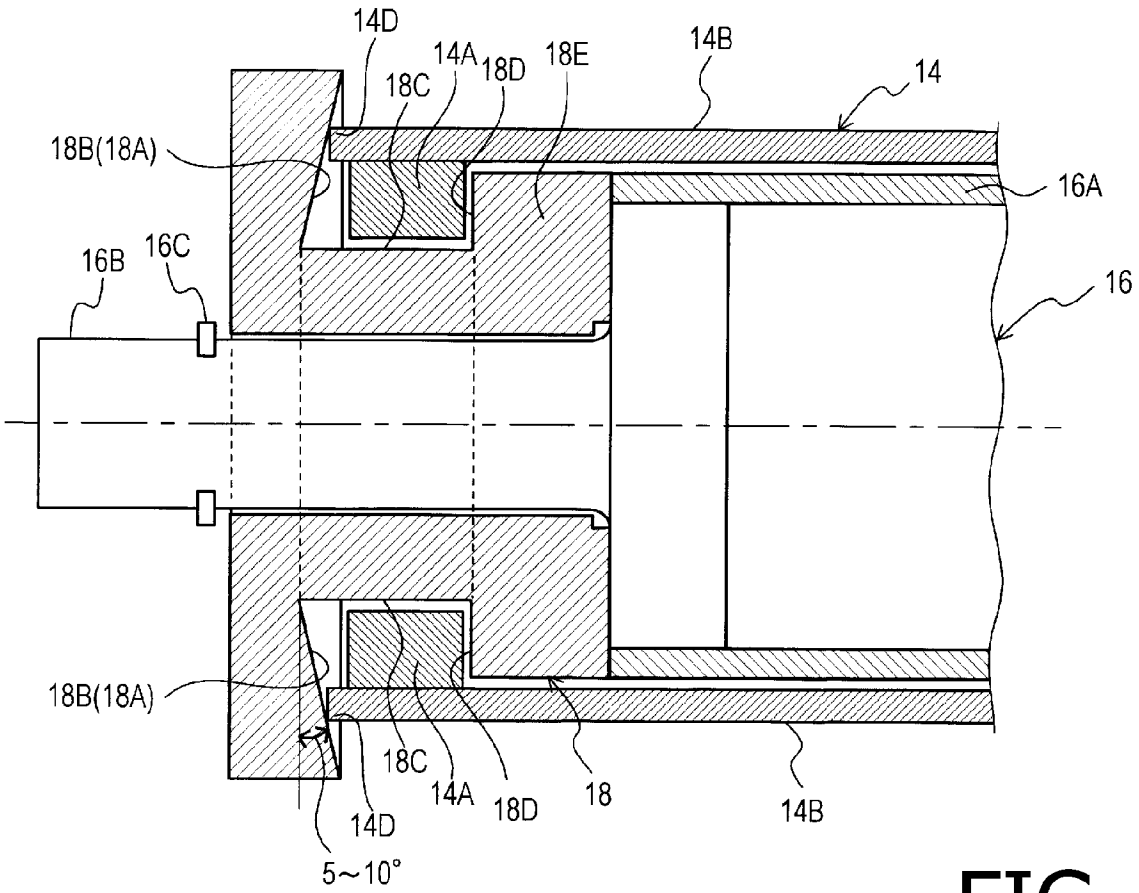

FIG. 4 is an enlarged cross sectional view of an axial end portion of the driving roller according to a first embodiment of the invention.

Figure 5:
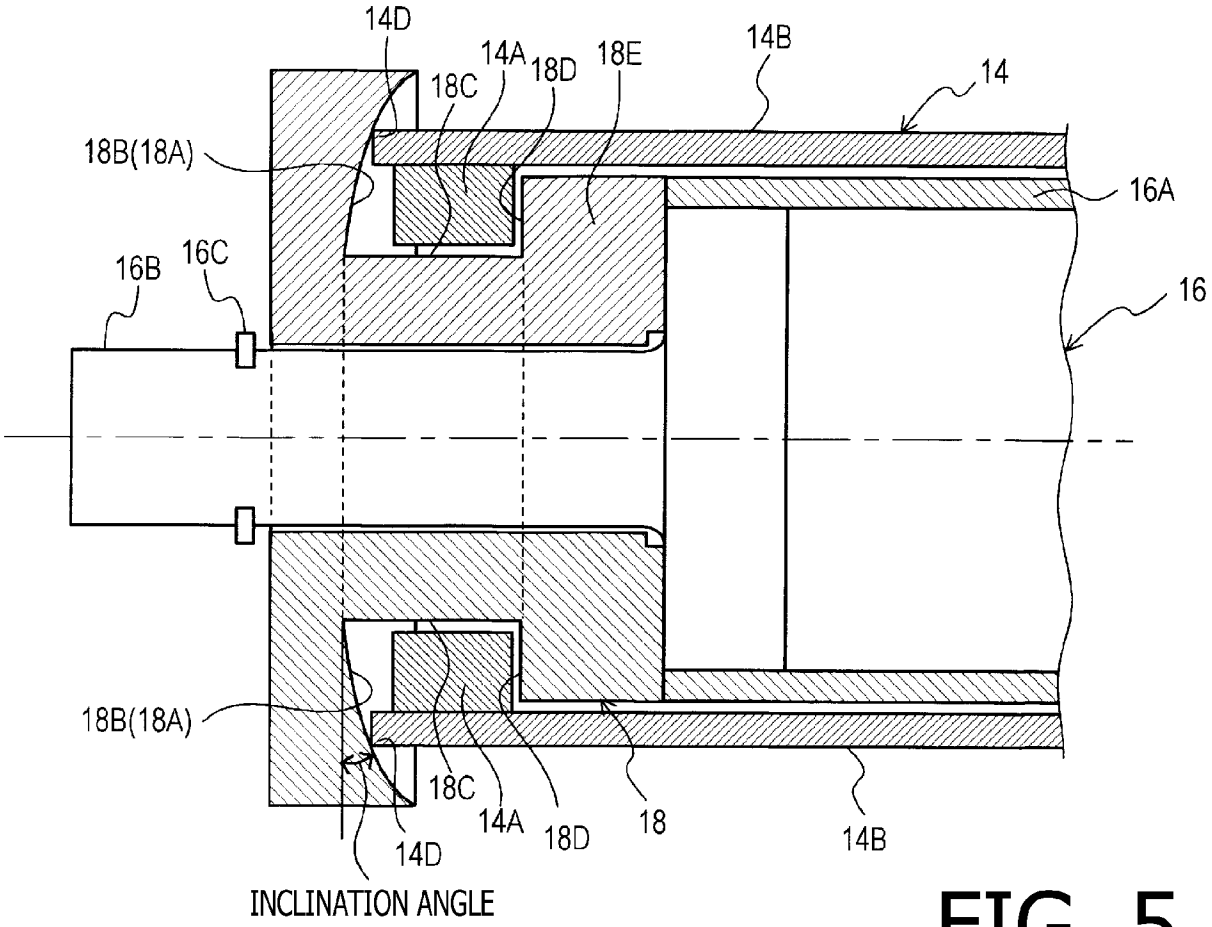

FIG. 5 is an enlarged cross sectional view of an axial end portion of the driving roller according to a second embodiment of the invention.

Figure 6:
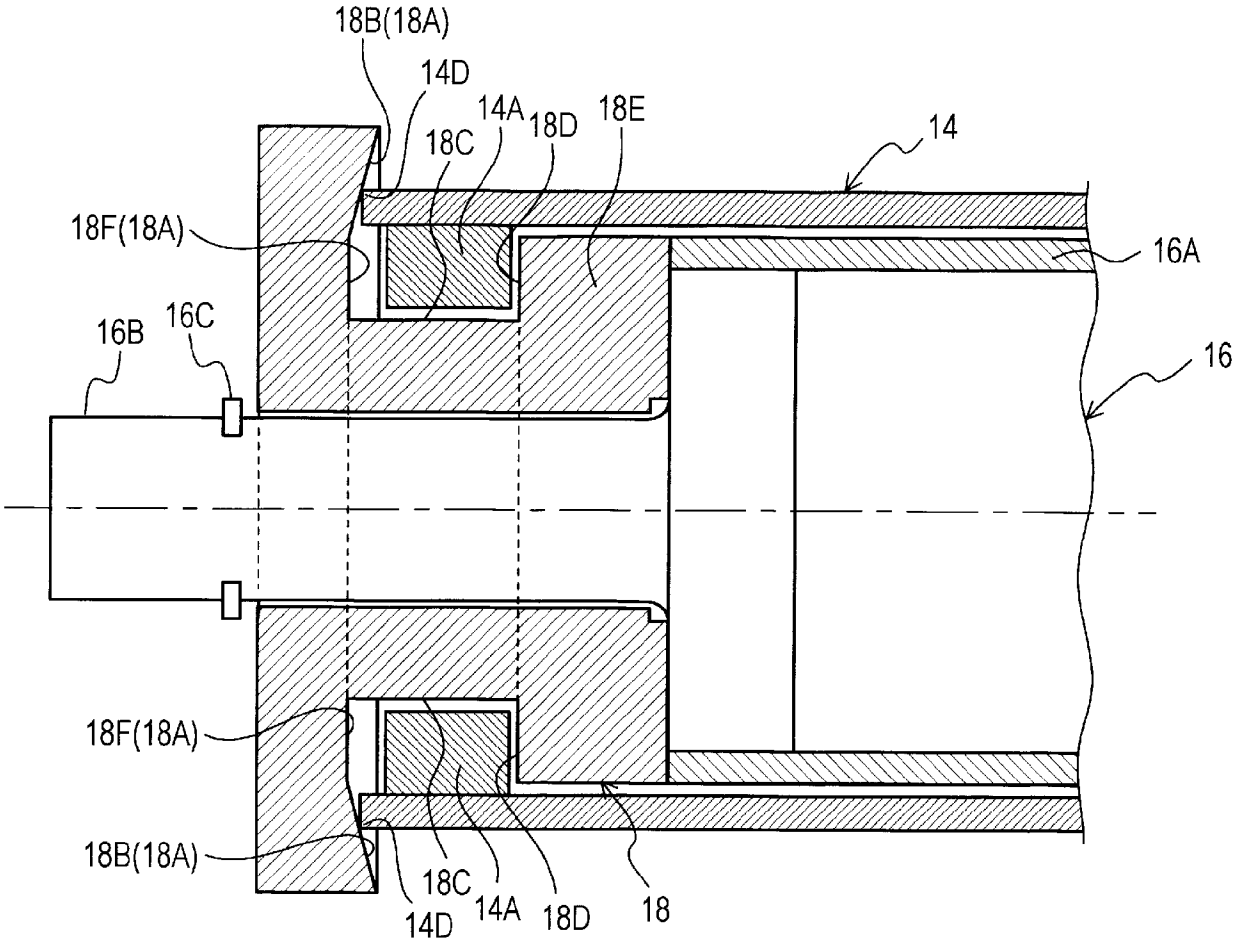

FIG. 6 is an enlarged cross sectional view of an axial end portion of the driving roller according to a third embodiment of the invention.

Figure 7:
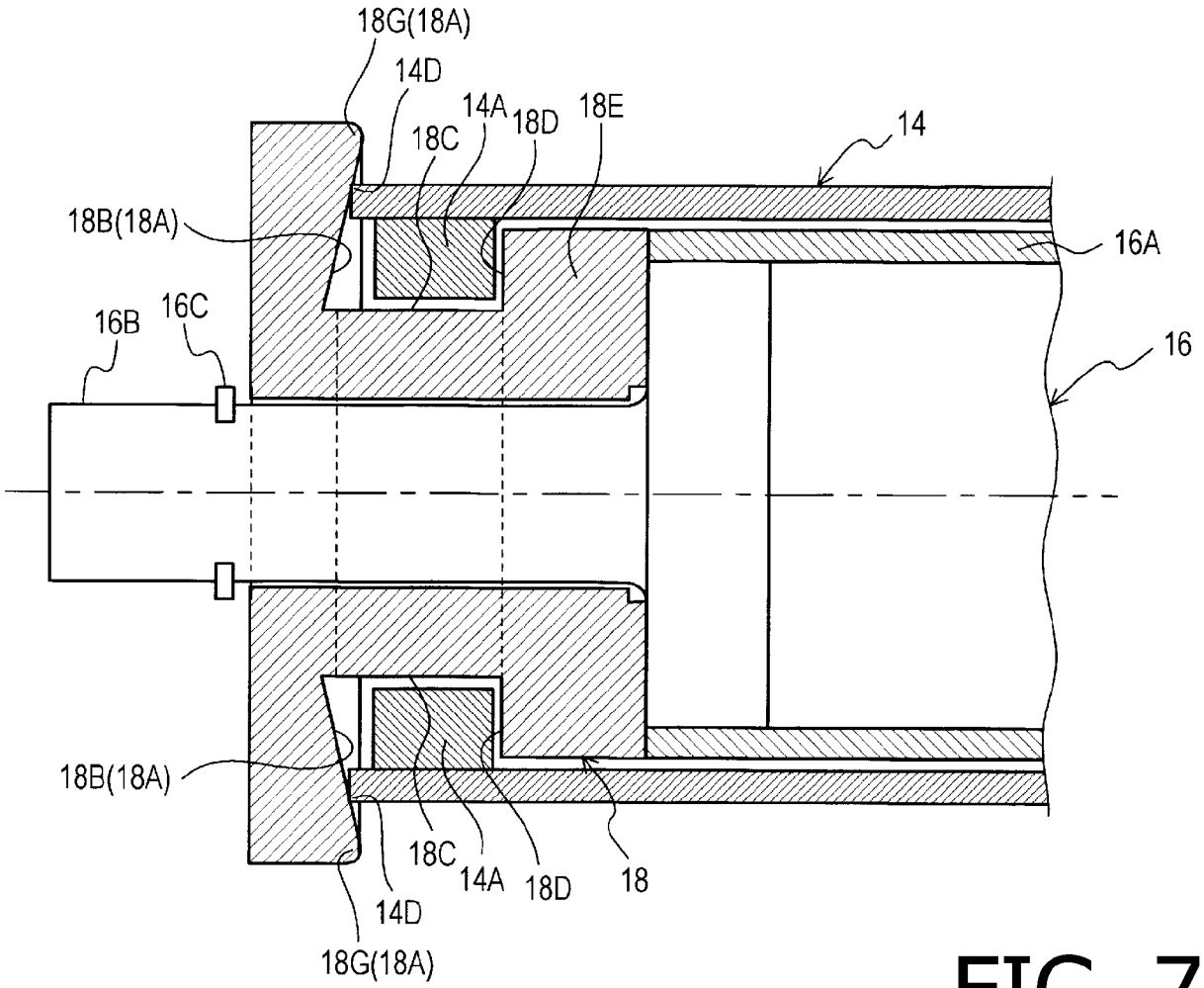

FIG. 7 is an enlarged cross sectional view of an axial end portion of the driving roller according to a fourth embodiment of the invention.

Figure 8:
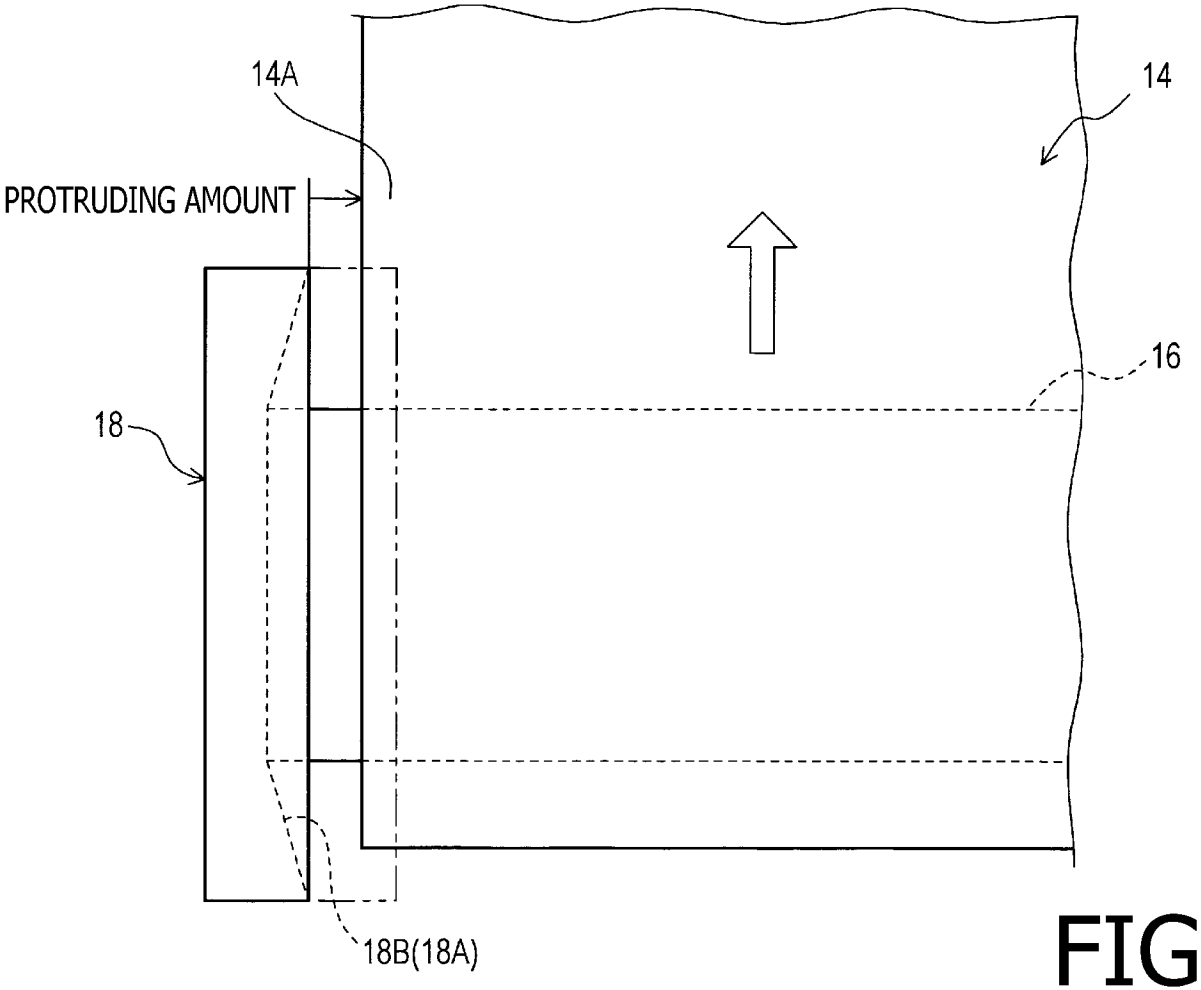

FIG. 8 shows a part of a belt unit viewed from an up-and-down direction, according to the fourth embodiment of the invention, to show characteristic features of the driving roller.

Figure 9:
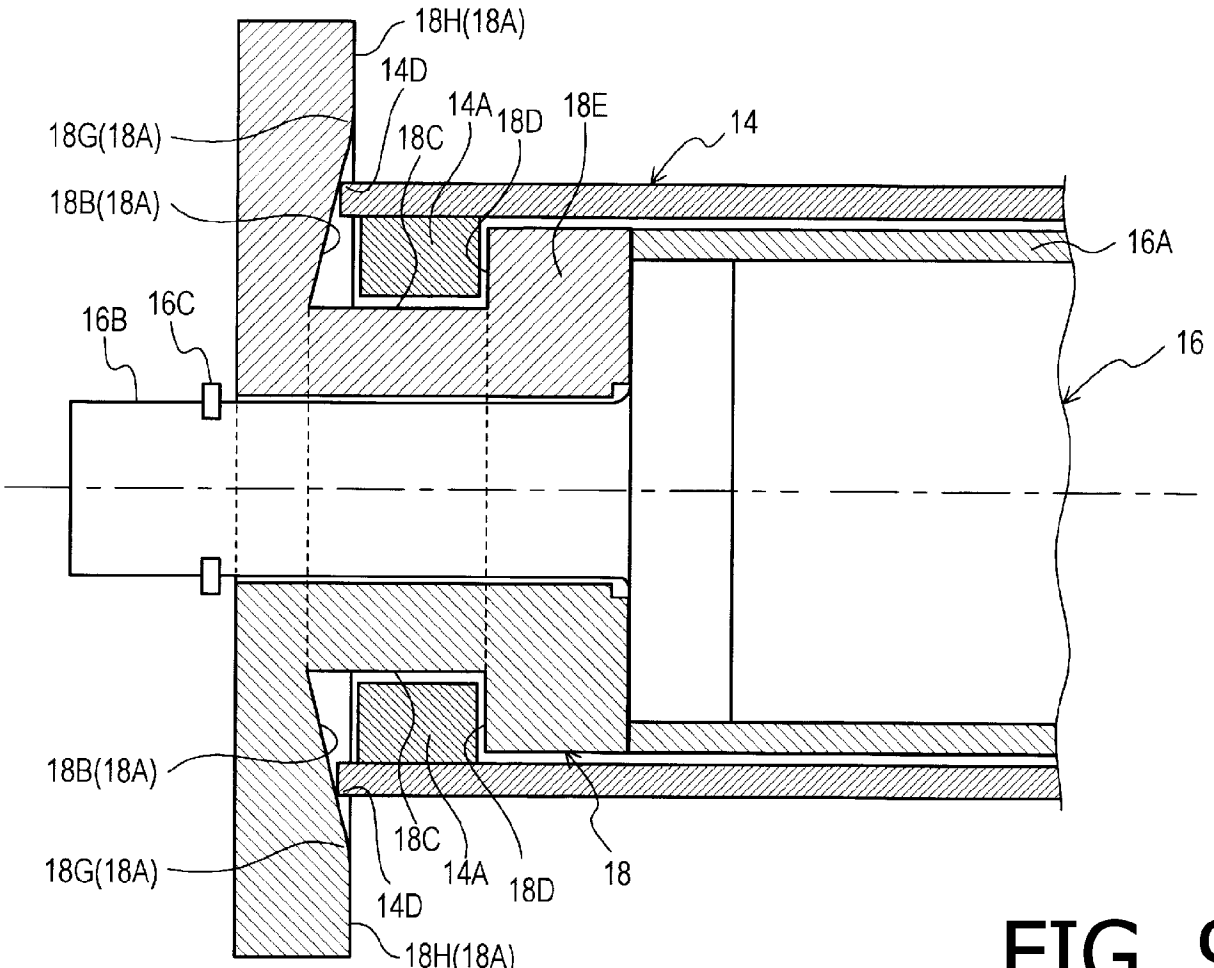

FIG. 9 is an enlarged cross sectional view of an axial end portion of the driving roller according to a fifth embodiment of the invention.

EMBODIMENTS

Hereinafter, image formation devices according to embodiments of the invention will be described, referring to the accompanying drawings. According to the embodiments, the image formation devices are ones according to an electrophotographic image formation method.

First Embodiment

Image Formation Device

An image formation device 1 has a housing 3 which accommodates an image formation unit 5 which is configured to form an image on a printing sheet or an OHP (overhead projector) sheet (hereinafter, simply referred to as a sheet) by applying developer (e.g., toner) in accordance with the electrophotographic image formation method.

Specifically, the image formation unit 5 is a so-called direct tandem type image formation unit. The image formation unit 5 includes a plurality of (four, in this embodiment) process units 7, transfer rollers 8, an exposure unit 9 and a fixing unit 11.

According to the embodiment, there are provided a process unit 7K for black image, a process unit 7Y for yellow image, a process unit 7M for magenta image, and a process unit 7C for cyan image, which are arranged serially in the sheet feed direction, in this order from the upstream side to the downstream side in the sheet feed direction.

Each of the process units 7K-7C includes a photoconductive drum 7A and a charger 7B for uniformly charging the circumferential surface of the photoconductive drum 7A. The charged photoconductive drum 7A is exposed to a light beam emitted by the exposure unit 9 so that electrostatic latent image is formed on the circumferential surface of the photoconductive drum 7A. Then, when the developer is supplied to the photoconductive drum 7A, the developer attracted on the circumferential surface of the photoconductive 7A at a portion corresponding to the electrostatic latent image, that is, an image is developed.

At positions opposite to the photoconductive drums 7A with the transfer belt 14 for feeding the sheet therebetween, transfer rollers 8 for applying developer on the sheet are provided. The developer carried by each photoconductive drum 7A is transferred onto the sheet fed by the transfer belt 14 so that the four color images are directly overlaid on the sheet. Then, the transferred images are heated by the fixing unit 11 and fixed on the sheet.

Figure 2:
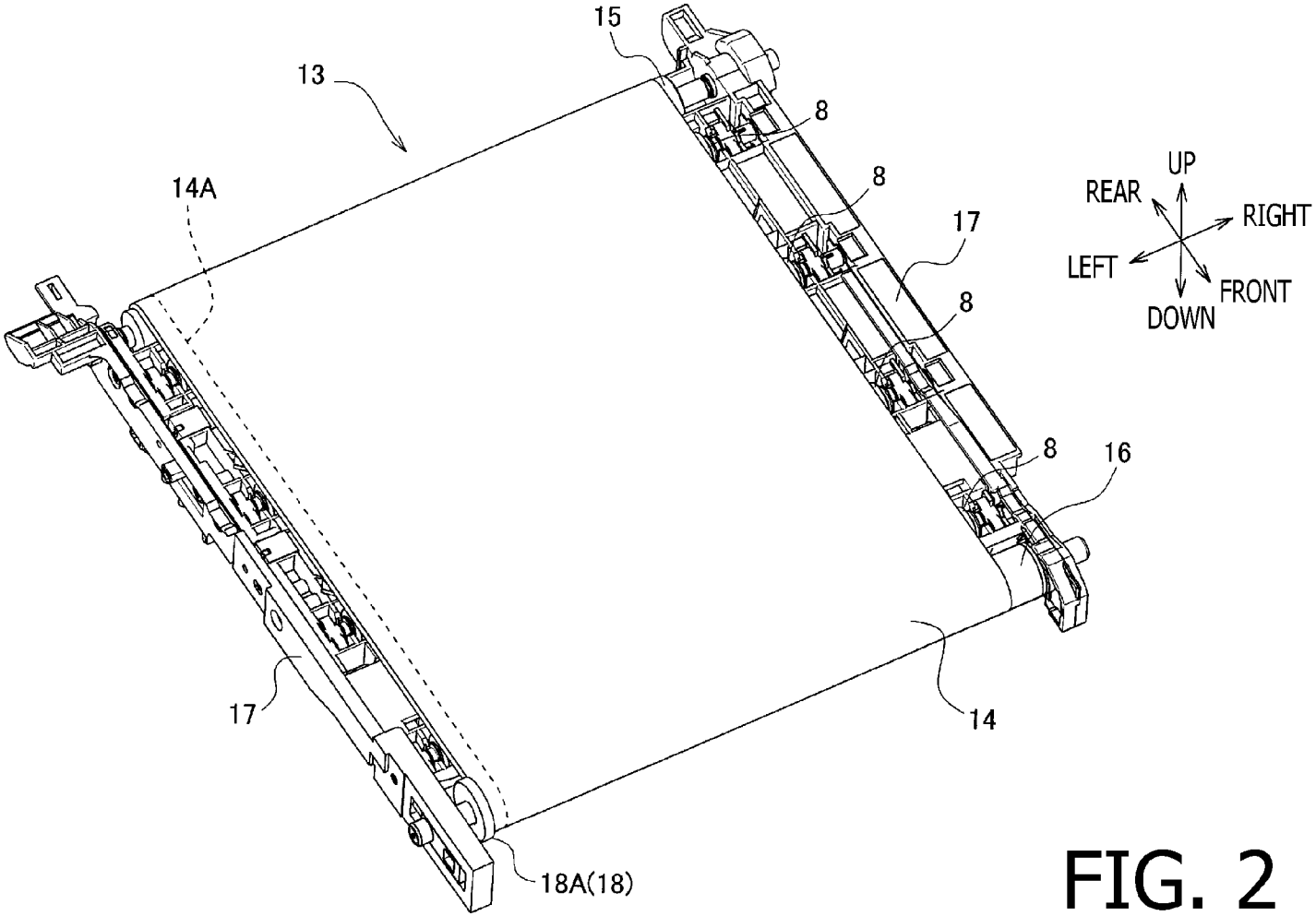
FIG. 2 is a perspective view of a belt unit employed in the image formation device shown in FIG. 1.

The belt unit 13 is provided with, as shown in FIG. 2, a transfer belt 14, a driving roller 15, a driven roller 16, and frames 17 which rotatably support the driving roller 15 and the driven roller 16 at their axial end portions. The belt unit 13 is configured to be removably attached to the main body of the image formation device 1.

Figure 1:
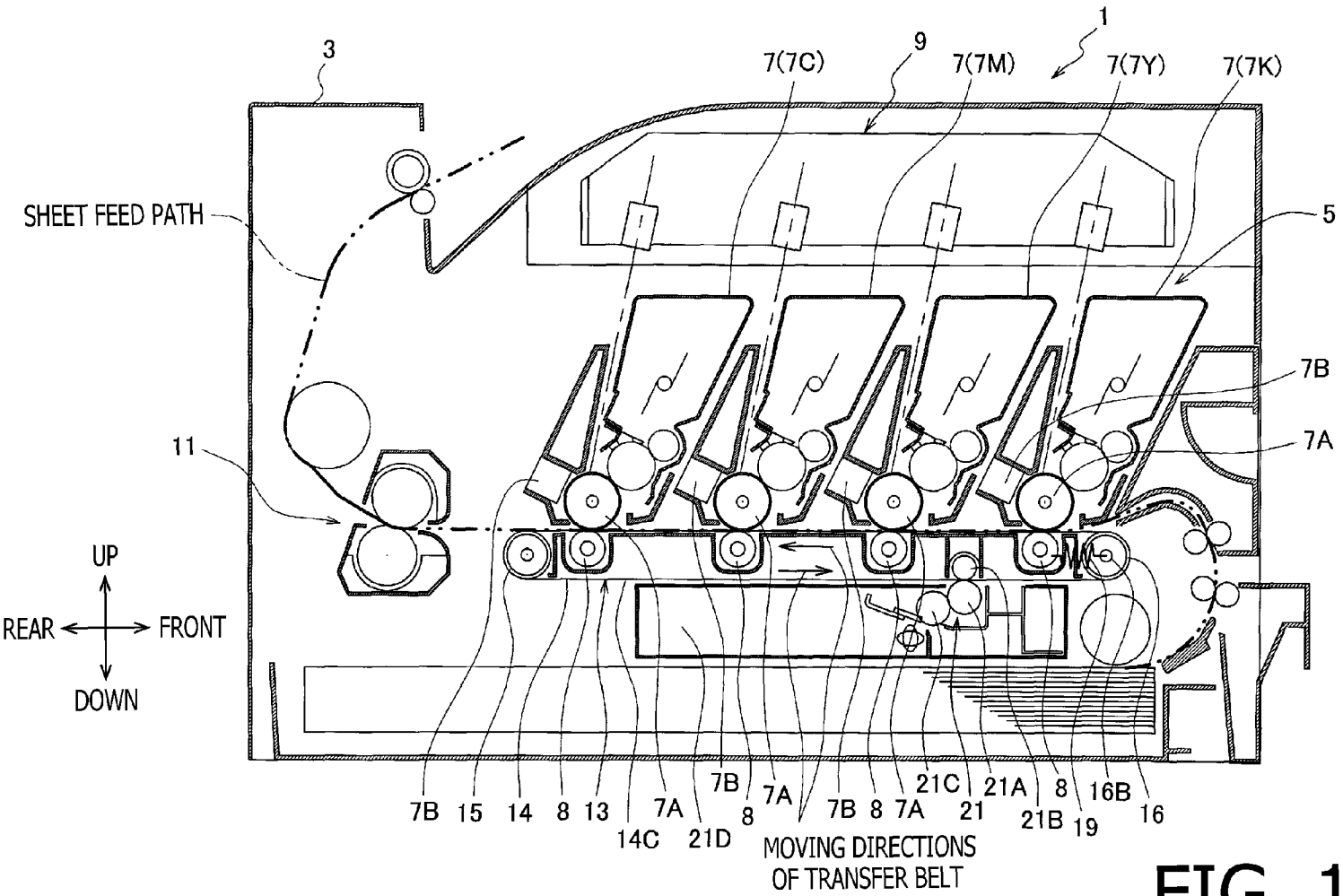
FIG. 1 is a cross sectional side view of an image formation device according to an embodiment of the invention.

The transfer belt 14 is an endless belt made of resin (which has thermoplastic elastomer resin) and wound around the driving roller 15 and the driven roller 16 (see FIG. 1).

On the inner surface of the transfer belt 14, guiding ribs 14A are arranged along a direction in which the transfer belt 14 rotates (see FIG. 3A). The guiding ribs 14 are inwardly protruded from the inner surface of the transfer belt 14. As shown in FIG. 3B, the guiding ribs 14A are provided at one end portion in the width direction, displaced on the center side with respect to the end of the transfer belt 14 (e.g., the left-hand side end of the transfer belt 14 in FIG. 3B).

According to the embodiment, the guiding ribs 14A integrally secured on the transfer belt with adhesive agent or by vulcanizing. It is noted that the width direction of the transfer belt 14 means a direction parallel with the axes of the driving roller 15 and/or driven roller 16.

The driving roller 15 is coupled with the frame 17 such that the driving roller 15 is rotatably supported by the frame 17, while the axial position with respect to the frame 17 is fixed. The driving roller 15 obtains a driving force directly or indirectly from a motor (not shown) provided in the main body of the image formation device 1.

The driven roller 16 is arranged in parallel with the driving roller 15, and the driven roller 16 is secured to the frame 17 such that the driven roller 16 is displaceable in a direction parallel with a direction in which tension is applied to bridging parts of the transfer belt 14. The bridging parts are planar parts of the transfer roller 14 bridging between the driving roller 15 and the driven roller 16, and indicated by reference numeral 14C.

The driven roller 16 is biased by a coil spring 19 in a direction in which a distance between the driving roller 15 and the driven roller 16 increases. Therefore, the driven roller 16 serves as a tension roller that applies a predetermined tension force to the bridging part 14C of the transfer belt. Therefore, when the driving roller 15 rotates, the transfer belt 14 moves, without slipping with respect to the driving roller 15 and the driven roller 16, together with the driving roller 15.

The driven roller 16 has a roller part 16A which has a cylindrical shape and contacts the inner surface of the transfer belt 14, and a roller shaft 16B which closes both axial side ends of the roller part 16A and rotatably supports the roller part 16A.

At an axial end portion of the driven roller 16 on the side same as the guiding rib 14A, a collar 18 having a flange surface 18A which extends in a radial direction is rotatably provided to the roller shaft 16B. The collar 18 is prevented from being drawn out from the roller shaft 16B with a retaining ring 16C.

The flange surface 18A expands to an outside of an outer surface 14B of the transfer belt 14 at a portion where the transfer belt 14 is wound around one of the driving roller 15 and driven roller 16. That is, in FIG. 3B, length $\phi 2$ is greater than length $\phi 1$. On the flange surface 18A, a surface facing the end portion of the transfer belt 14 is configured to have an inclined conical surface 18B. As shown in FIG. 4, the conical surface 18B is formed such that an outer portion thereof is closer to an axial center of the roller 15 (or 16). According to the embodiment, the conical surface 18B is defined by a linear generating line, and inclination angle of the generating line with respect to a direction perpendicular to the axial direction thereof is constant.

On the collar 18, a groove 18C in which the guiding rib 14A is inserted is formed. An axial end side (i.e., a left-hand side) one of a pair of side walls defining the groove 18 is formed with the flange surface 18A (i.e., the inclined surface 18B). The term "a pair of side walls defining the groove 18C" means a pair of walls spaced from and facing each other, in the axial direction, among the inner walls of the groove 18C.

Because of the above configuration, if the transfer belt 14 moves obliquely in one axial direction (i.e., in the flange surface 18A side) when the guiding rib 14A is fitted in the groove 18C, the flange surface 18A and an end, in the width direction, of the transfer belt 14 contact. Thus, the flange surface 18A serves as a regulating surface which prevent the transfer belt 14 to move obliquely in one side along the axial direction.

If the transfer belt obliquely moves in the opposite direction (i.e., opposite to the flange surface 18A side), with the guiding rib 14A being inserted in the groove 18C, the side surface of the guiding rib 14A contacts a side surface 18D which is one of the pair of surfaces defining the groove 18C and is a surface facing the flange surface 18A (see FIG. 4).

Incidentally, the driving roller 15 has substantially the same structure as the driven roller 16 except that the driving roller 15 is not provided with the collar 18. At one axial end portion (in the embodiment, a side where the guiding rib 14A is not provided), a gear (not shown) which receives a driving force from a motor provided to the main body and transmits the driving force to the driving roller 15.

The collar 18 slidably contacts the transfer belt 14 and the roller shaft 16B of the driven roller 16. Therefore, the collar 18 is made of resin having high anti-abrasion property and low friction resistance (e.g., POM).

Incidentally, the collar 18 is a die-forming member. Therefore, according to the embodiment, considering die forming process, the flange surface 18A and the main part 18E formed with the groove 18C are formed separately, and then the flange surface 18A and the main part 18E are assembled to form an integral entirety.

Belt Unit

According to the embodiment, the flange surface 18A expands to outside of the outer surface 14B of the transfer belt 14. Therefore, in order for the obliquely moving, which is moving toward one side of the transfer belt 14, to climb over the flange surface 18A, the transfer belt 14 must move in an opposite direction (i.e., right-hand side in FIG. 4) as guided by the inclined conical surface 18B, and then, move back in the firstly directed direction (i.e., the left-hand side in FIG. 4).

That is, the conical surface 18B functions as if the peripheral portion of the flange surface 18A is bent toward the axially central part of the driven roller 16. Therefore, with this configuration, it is possible to suppress the transfer belt 14 from climbing over the flange surface 18A sufficiently.

If the above configuration is not employed and the flange surface has a simple disk-like shape, it is necessary to make the flange surface to have a sufficiently large diameter in order to prevent the climbing over of the transfer belt 14.

According to the embodiment, however, by employing the conical surface 18B, it is possible to prevent the transfer belt 14 from climbing over the flange surface 18A even in the flange surface 18A has a relatively small diameter. Therefore, according to the embodiment, it is possible to prevent the climbing over of the transfer belt 14 with suppressing upsizing of the belt unit 13.

Incidentally, according to the embodiment, the conical surface 18B is formed such that the inclination angle, with respect to the axial direction, is within a range of five degrees through ten degrees, in order that the above effect can be well achieved.

Therefore, collar 18 and the guiding rib 14A are provided only at one side (i.e., the left-hand side in FIG. 4), the oblique movement of the transfer belt 14 can be suppressed effectively. Further, in comparison with a case where the collars 18 and the guiding ribs 14A are provided on both sides in the axial direction, the manufacturing cost of the belt unit 13 can be suppressed.

If the transfer belt 14 obliquely moves in one direction (i.e., in the left-hand side in FIG. 4), the one side portion of the transfer belt 14 contacts the flange surface 18A, thereby relatively large frictional force (i.e., resistance force) acts on the transfer belt 14. If the frictional force is relatively large, the transfer belt 14 may climb over the flange surface 18A.

In contrast, according to the present invention, the guiding rib 14A is provided at a position which is shifted toward the axially central position (i.e., the right-hand side in FIG. 4) with respect to the axial end position (i.e., the left-hand side end in FIG. 4). Therefore, when the transfer belt 14 moves obliquely toward the axial end portion, the a protruded portion 14D, which is protruded from the guiding rib 14A towards the flange surface 18A, firstly contacts the flange surface 18A.

A contacting area between the protruded portion 14D and the flange surface 18A is sufficiently smaller than that between the guiding rib 14A and the flange surface 18A. Therefore, the frictional force which is generated when the protruded portion 14D contacts the flange surface 18A is sufficiently smaller than the frictional force which is generated when the guiding rib 14A contacts the flange surface 18A. Therefore, according to the embodiment, it is ensured that the transfer belt 14 is prevented from climbing over the flange surface 18A.

In the above-described embodiment, the collar 18 is provided only to the driven roller 16. It is confirmed by experiment that, according to such a configuration, early deterioration of the transfer belt 14 can be suppressed in comparison with a case where the collar 18 is provided only to the driving roller 15, or to both the driving roller 15 and the driven roller 16.

Second Embodiment

According to the first embodiment, the conical surface 18B is formed such that the inclination angel with respect to a direction perpendicular to the axial direction has a fixed value. According to the second embodiment, the inclination angle of the generating line is varied such that a portion closer to the peripheral side has a larger inclination angle as shown in FIG. 5. Thus, a cross section of the conical surface 18B is represented by a curved line.

Third Embodiment

According to the first and second embodiments, the conical surface is formed substantially on an entire area of the flange surface 18A. According to the fourth embodiment, as shown in FIG. 6, a planar surface 18F, which extends in a direction perpendicular to the axial direction, is formed on the rotationally central portion of the flange surface 18A.

Specifically, the planar surface 18F is smoothly connected to the conical surface 18B, and a portion configuring the side wall of the groove 18C is formed as a planar surface perpendicular to the axial direction, not an inclined surface, as shown in FIG. 6. It is noted that the third embodiment can be defined such that a planer surface which extends perpendicular to the axial direction is formed at the central area of the flange surface 18A, and such a configuration can be applied not only to the first embodiment, but to any other embodiments having been described or will be described hereinafter.

Fourth Embodiment

As shown in FIG. 7, according to the fourth embodiment, the peripheral portion of the conical surface 18B (i.e., an outer end portion of the flange surface 18A in FIG. 7) is rounded to define a rounded portion 18G. It is noted that such a configuration can be applied not only to the first embodiment, but to any other embodiments having been described or will be described hereinafter.

If the peripheral portion of the conical surface 18B protrudes too much as indicated by two-dot chain line in FIG. 8, the side portion of the bridging portion 14C of the transfer belt 14 may interfere with (contact) the conical surface 18B. According to the fourth embodiment, since the peripheral end portion of the conical surface 18B is formed to be the rounded portion 18G, even if the transfer belt 14 contacts the outer peripheral portion of the flange surface 18A, damage of the transfer belt 14 can be suppressed.

It is noted that the conical surface 18B indicated by solid lines in FIG. 8 shows the conical surface 18B in its actual form. As mentioned above, the inclination angle of the generating line is relatively small (i.e., within a range of five degrees to ten degrees), the conical surface 18B appears to be a substantially planar surface perpendicular to the axial direction.

Fifth Embodiment

In the fifth embodiment, as shown in FIG. 8, an outer flange portion 18H is additionally provide on the outer periphery of the conical surface 18B. If the configuration is applied to the fourth embodiment, the outer flange portion 18H is provided on the outer periphery of the rounded portion 18G. The outer flange portion 18H is smoothly connected to the conical portion 18B (or the rounded portion 18G).

With this configuration, similar to the fourth embodiment, damage of the transfer belt 14 can be suppressed. It is noted that the outer flange portion 18H show in FIG. 9 has a planar surface extending in a direction perpendicular to the axial direction. However, the configuration of the fifth embodiment needs not be limited to that of the embodiment, and can be modified in various ways. For example, the surface of the outer flange portion 18H may be a conical surface of which the inclination angle is smaller than that of the conical surface 18B.

It is noted that the fifth embodiment can be used in combination of any of first through fourth embodiments.

Other Embodiments

Further, according to the above-described embodiments, the image formation device is a direct-type device in which the developer (developed image generated by the image formation unit 5) is directly transferred onto the sheet being fed by the transfer belt 14, or indirectly transferred by the transfer belt 14. The invention needs not to be limited to such a configuration, and can be applied to different types of image formation devices. For example, the image formation device may be an intermediate transfer type which is configured such that the developer is once transferred onto the transfer belt 14 and then transferred onto the sheet. For another example, the image formation device may be a inkjet type image formation device.

Further, according to the above-described embodiments, the collar 18 is provided only to the driven roller 16. The invention needs not be limited to such a configuration, but can be modified such that the collar 18 is provided only to the driving roller, or to both the driving roller 15 and the driven roller 16.

In the embodiments described above, the invention is applied to a belt unit of the image formation device. It is noted that the invention needs not be limited to the above-described exemplary embodiments, and can be modified in various ways. For example, the invention can be applied to a belt device configured to feed a sheet for image scanner.

According to the embodiments, the guiding rib 14A is provided to the transfer belt 14. The invention needs not be limited to such a configuration, and can be modified to be applicable to a device where the guide lib 14A and the groove 18C are omitted.

Specifically, in such a modification, the collar 18 may be provided to each axial end of the driving or driven rollers 15, 16 and arrange the collars 18 so that the flange surfaces thereof face each other. Alternatively, the collar 18 may be provided to only one axial end of the roller, and configure the transfer belt 14 to move obliquely toward the collar 18 side.

As a concrete example to cause the transfer belt 14 to obliquely move toward the collar side, for example, a pressing force of one of the coil springs 19 may be made stronger than the other so that tension force generated on the transfer belt 14 at one axial end is stronger to that at the other axial end. With such a configuration, the transfer belt 14 may move obliquely from the portion where the tension is stronger to the portion where the tension is weaker.

It is noted that a plurality of embodiments are described, and any appropriate combination of parts of respective embodiments should be considered within the scope of the invention.

What is claimed is:

1. A belt unit, comprising:

an endless belt;

a pair of rollers around which the endless belt is wound, wherein each of the rollers extends a length in an axial direction and has an axial center located midway along the length of the respective roller; and a regulating member having a flange provided at one end, in an axial direction which is a direction of a central axis of at least one of the pair of rollers, the flange extending in a direction generally perpendicular to the central axis and on an outer side with respect to an outer surface of the endless belt, the flange having a conical surface configured to contact an end, in the axial direction, of the endless belt to prevent the endless belt from moving toward the flange, wherein the conical surface is defined by a generating line which is curved such that an inclination angle of the generating line with respect to a direction perpendicular to the axial direction is larger at a portion closer to an outer periphery, wherein a distance between a portion on the conical surface farther away from the central axis and a reference axis extending through the axial center of the at least one of the pair of rollers and perpendicular to the central axis is smaller than a distance between a portion on the conical surface closer to the central axis and the reference axis, wherein the distances between the portions of the conical surface and the reference axis are taken in a direction parallel to the central axis, wherein the endless belt is formed with a guiding rib on an inner surface thereof such that the guiding rib protrudes inwardly and extends along a moving direction of the endless belt, and wherein the regulating member is formed with a groove, the groove having two side surfaces opposing with each other in the axial direction, one of the two side surfaces being a part of the conical surface of the flange, the groove being configured to receive the guiding rib inserted between the two side surfaces, the other of the two side surfaces being configured to contact the guiding rib to prevent the endless belt from moving toward an opposite end, in the axial direction, to the one axial end at which the flange is provided.

2. The belt unit according to claim 1, wherein the regulating member and the guiding rib are provided on only one axial side of the at least one of the pair of rollers.

3. The belt unit according to claim 1, wherein the guiding rib is formed on the endless belt at a position shifted toward a center, in a width direction, with respect to the end, in the width direction, of the endless belt.

4. The belt unit according to claim 1, wherein the conical surface is defined by a generating line which is linear, such that an inclination angle of the generating line with respect to a direction perpendicular to the axial direction is constant.

5. The belt unit according to claim 1, wherein the conical surface is provided on an outer periphery of the flange surface, and wherein the flange surface includes a planar surface extending in a direction perpendicular to the axial direction, the planar surface being formed on a portion closer to an axis of the roller.

6. The belt unit according to claim 1, wherein a peripheral portion of the conical surface is formed to have a rounded portion having an arc-shaped cross section.

7. The belt unit according to claim 1, further comprising an outer flange portion which extends outward from an outer periphery of the conical surface.

8. An electrophotographic image formation device, comprising:

an image formation unit forming a developed image formed by developer; and a belt unit, which includes:

an endless belt;

a pair of rollers around which the endless belt is wound, wherein each of the rollers extends a length in an axial direction and has an axial center located midway along the length of the respective roller; and a regulating member having a flange provided at one end, in an axial direction which is a direction of a central axis of at least one of the pair of rollers, the flange extending in a direction generally perpendicular to the central axis and on an outer side with respect to an outer surface of the endless belt, the flange having a conical surface configured to contact an end, in a the axial direction, of the endless belt to prevent the endless belt from moving toward the flange, wherein the conical surface is defined by a generating line which is curved such that an inclination angle of the generating line with respect to a direction perpendicular to the axial direction is larger at a portion closer to an outer periphery, wherein a distance between a portion on the conical surface farther away from the central axis and a reference axis extending through the axial center of the at least one of the pair of rollers and perpendicular to the central axis is smaller than a distance between a portion on the conical surface closer to the central axis and the reference axis, wherein the distances between the portions of the conical surface and the reference axis are taken in a direction parallel to the central axis, wherein the developed image is transferred by the belt unit;

wherein the endless belt is formed with a guiding rib on an inner surface thereof such that the guiding rib protrudes inwardly and extends along a moving direction of the endless belt, and wherein the regulating member is formed with a groove, the groove having two side surfaces opposing with each other in the axial direction, one of the two side surfaces being a part of the conical surface of the flange, the groove being configured to receive the guiding rib to prevent the endless belt from moving toward an opposite end, in the axial direction, to the one axial end at which the flange is provided.

9. The electrophotographic image formation device according to claim 8, wherein the regulating member and the guiding rib are provided on only one axial side of the at least one of the pair of rollers.

10. The electrophotographic image formation device according to claim 8, wherein the guiding rib is formed on the endless belt at a position shifted toward a center, in a width direction, with respect to the end, in the width direction, of the endless belt.

11. The belt unit according to claim 8, wherein the conical surface is defined by a generating line which is linear, such that an inclination angle of the generating line with respect to a direction perpendicular to the axial direction is constant.

12. The electrophotographic image formation device according to claim 8, wherein the conical surface is provided on an outer periphery of the flange surface, and wherein the flange surface includes a planar surface extending in a direction perpendicular to the axial direction, the planar surface being formed on a portion closer to an axis of the roller.

13. The electrophotographic image formation device according to claim 8, wherein a peripheral portion of the conical surface is formed to have a rounded portion having an arc-shaped cross section.

14. The electrophotographic image formation device according to claim 8, further comprising an outer flange portion which extends outward from an outer periphery of the conical surface.

* * * * *